United States Patent [19]

Klamar

[11] 4,137,634

[45] Feb. 6, 1979

[54] UNIVERSAL CUSTOM FIT GARMENT PATTERNS AND METHOD OF USING THE SAME

[76] Inventor: John Klamar, 600 Madison Ave., New York, N.Y. 10022

[21] Appl. No.: 761,364

[22] Filed: Jan. 21, 1977

Related U.S. Application Data

[63] Continuation-in-part of Ser. No. 724,857, Sep. 20, 1976, abandoned.

[51] Int. Cl.[2] ..... A41H 3/06

[52] U.S. Cl. ..... 33/12; 33/14

[58] Field of Search ..... 33/12, 17 R, 11, 14, 33/16

[56] References Cited

U.S. PATENT DOCUMENTS 2,022,029 12/1935 Van Patten ..... 33/12

FOREIGN PATENT DOCUMENTS 128216 10/1928 Switzerland ..... 33/12

*Primary Examiner*—Richard E. Aegerter
*Assistant Examiner*—Willis Little
*Attorney, Agent, or Firm*—Allen D. Brufsky

[57] ABSTRACT

A universal size woman's garment pattern and the method of customizing and shaping the pattern to the individual figure dimensions of a woman is disclosed.

3 Claims, 20 Drawing Figures

Fig. 2

HIP MEASUEMENT CHART (IF YOUR MEASUREMENT FALLS BETWEEN SIZES ALWAYS CHOOZE THE LARGER SIZE FOR THE HIP)

| IF YOUR HIP MEASUREMENT IS: | YOUR CORRESPONDING PATTERN SIZE IS: |
|---|---|
| 34 OR UNDER* | 6 |
| 36 | 8 |
| 38 | 10 |
| 39 1/2 | 12 |
| 41 1/2 | 14 |
| 43 | 16 |
| 45 | 18 |
| 46 OR OVER* | 20 |

22

36

24

WAIST MEASUREMENT CHART (IF YOUR MEASUREMENT FALLS BETWEEN SIZES ALWAYS CHOOZE THE LARGER SIZE FOR THE WAIST)

| IF YOUR WAIST MEASUREMENT IS: | YOUR WAIST SIZE TO MARK IS: |
|---|---|
| 23 | 6 |
| 24 | 8 |
| 26 | 10 |
| 27 1/2 | 12 |
| 29 | 14 |
| 30 1/2 | 16 |
| 32 1/2 | 18 |
| 33 1/2 | 20 |

38

CHART TO NARROW THE PATTERN

26

| IF YOUR HIP MEASUREMENT IS: | THE AMOUNT TO BE NARROWED IS: |
|---|---|
| 33 | 1/4" |
| 32 | 1/2" |
| 31 | 3/4" |
| 30 | 1" |
| 29 | 1 1/4" |
| 28 | 1 1/2" |
| 27 | 1 3/4" |

40

36

* NARROW THE SAME AMOUNT ON THE FRONT AND BACK PATTERNS

28

CHART TO ENLARGE THE PATTERN

| IF YOUR HIP MEASUREMENT IS: | THE AMOUNT TO BE ENLARGED IS: |
|---|---|
| 46 | 1/4" |
| 47 | 1/2" |
| 48 | 3/4" |
| 49 | 1" |
| 50 | 1 1/4" |
| 51 | 1 1/2" |
| 52 | 1 3/4" |
| 53 | 2" |
| 54 | 2 1/4" |
| 55 | 2 1/2" |
| 56 | 2 3/4" |

40

* ENLARGE THE SAME AMOUNT ON THE FRONT AND BACK PATTERNS

Fig. 11g.

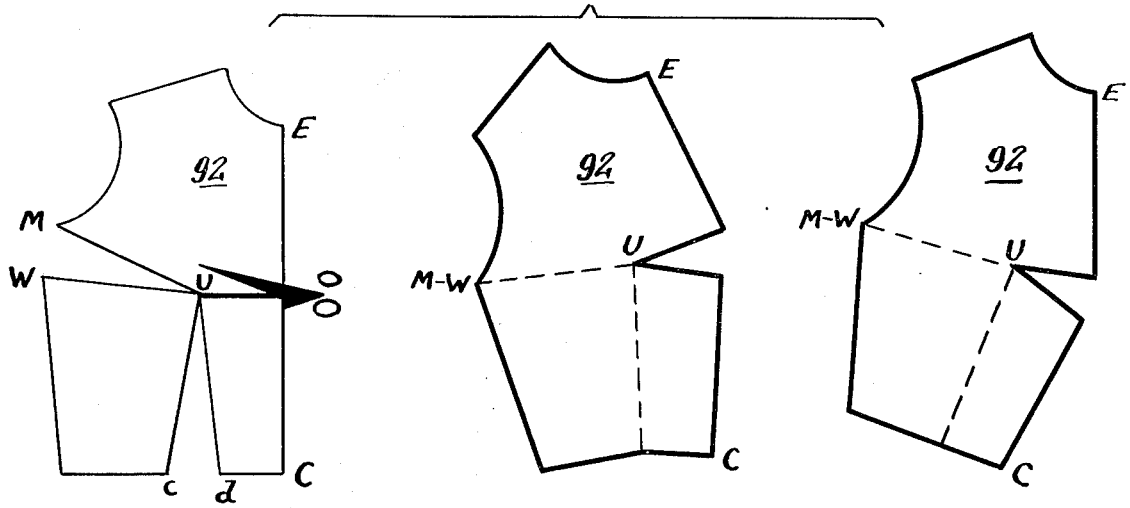

Fig. 2.

24

HIP MEASUREMENT CHART

(IF YOUR MEASUREMENT FALLS BETWEEN SIZES, ALWAYS CHOOSE THE LARGER SIZE FOR THE HIP)

22

| IF YOUR HIP MEASUREMENT IS: | YOUR CORRESPONDING PATTERN SIZE IS: |
|---|---|
| 34 OR UNDER * | 6 |
| 36 | 8 |
| 38 | 10 |
| 39 1/2 | 12 |
| 41 1/2 | 14 |
| 43 | 16 |
| 45 | 18 |
| 46 OR OVER ** | 20 |

36

WAIST MEASUREMENT CHART

(IF YOUR MEASUREMENT FALLS BETWEEN SIZES, ALWAYS CHOOSE THE LARGER SIZE FOR THE WAIST)

| IF YOUR WAIST MEASUREMENT IS: | YOUR WAIST SIZE TO MARK IS: |
|---|---|
| 23 | 6 |
| 24 | 8 |
| 26 | 10 |
| 27 1/2 | 12 |
| 29 | 14 |
| 30 1/2 | 16 |
| 32 1/2 | 18 |
| 33 1/2 | 20 |

38

26

CHART TO NARROW THE PATTERN

| IF YOUR HIP MEASUREMENT IS: | THE AMOUNT TO BE NARROWED IS:* |
|---|---|
| 33 | 1/4" |
| 32 | 1/2" |
| 31 | 3/4" |
| 30 | 1" |
| 29 | 1 1/4" |
| 28 | 1 1/2" |
| 27 | 1 3/4" |

40

36

* NARROW THE SAME AMOUNT ON THE FRONT AND BACK PATTERNS

28

CHART TO ENLARGE THE PATTERN

| IF YOUR HIP MEASUREMENT IS: | THE AMOUNT TO BE ENLARGED IS:* |
|---|---|
| 46 | 1/4" |
| 47 | 1/2" |
| 48 | 3/4" |
| 49 | 1" |
| 50 | 1 1/4" |
| 51 | 1 1/2" |
| 52 | 1 3/4" |
| 53 | 2" |
| 54 | 2 1/4" |
| 55 | 2 1/2" |
| 56 | 2 3/4" |

40

* ENLARGE THE SAME AMOUNT ON THE FRONT AND BACK PATTERNS

80
UNDERARM LINE
UNDERARM LINE
LINE TO ENLARGE OR NARROW
LINE TO ENLARGE OR NARROW
84
82
A
B
C
C1
C2
D1
D3
E
E1
F
F1
G1
G2
H1
H3
J
K
L
M
N1
N3
O1
O3
P
Q
R
T
U
V
W
Y
Z

Fig. 8.

100

BUST MEASUREMENT CHART

| IF YOUR BUST MEASUREMENT IS: | YOUR CORRESPONDING PATTERN SIZE IS: |
|---|---|
| 31 OR UNDER | 6 |
| 33 | 8 |
| 35 | 10 |
| 36 1/2 102 | 12 104 |
| 39 1/2 | 14 |
| 41 | 16 |
| 43 | 18 |
| 44 OR OVER | 20 |

* IF YOU ARE BETWEEN SIZES, CHOOSE THE SMALLER SIZE TO GET A CLOSELY FITTED GARMENT, OR THE LARGER SIZE FOR A LOOSER FIT

CENTER LINE OF THE FRONT PATTERN
PLACE PATTERN ON FOLD OF FABRIC
UNDERARM LINE
FRONT
BUST LINE
92
WAIST LINE
110
112
FOLD
90

BACK
UNDERARM LINE
94
CENTER BACK
BACK LENGTH
GRAIN LINE

UNIVERSAL CUSTOM FIT GARMENT PATTERNS AND METHOD OF USING THE SAME

CROSS REFERENCE TO RELATED APPLICATION

This application is a continuation-in-part of application Ser. No. 724,857, filed Sept. 20, 1976 in the name of John Klamar and entitled "Universal Custom Fit Garment Patterns and the Method of Using the Same" now abandoned.

BACKGROUND OF THE INVENTION

1. Field of the Invention

This invention relates to patterns for women's clothes, and more particularly, single universal patterns for forming a number of custom-fitted women's garments and components therefor, and the method of using the same.

2. Description of the Prior Art

Patterns for use in forming women's garments are well-known in the art. Heretofore, however, such patterns were tailored to a particular size of garment normally worn by the woman, without taking into account that no two women are built exactly the same with the exact same hip, waist or bust measurements. Accordingly, the pattern would be purchased and a garment sewn based on a particular dimension, such as waist size, hip size or bust size, but no provision was made to alter the pattern and the resultant garment to the exact figure dimensions in all three categories so that the resultant garment was custom-fitted to the exact individual dimensions of the wearer. The woman, therefore, is squeezed into a particular size garment, based on one figure measurement, rather than all of her dimensions, which vary from individual to individual.

About the only attempt made to develop a "universal" pattern for women's garments was to superimpose different or graduated sizes of one size determining component, e.g., waist sizes, represented by parallel lines on a paper pattern, so that if a women had a particular size waist she could cut the pattern from the paper that was tailored to that size. Examples of this type pattern are illustrated in U.S. Pat. Nos. 811,700; 2,531,781; and 2,568,805. Individual sections of a garment could be customized by cutting different patterns representing different sections of the garment, tailoring them to one particular dimension, and then cutting the cloth to conform to these size patterns and sewing the cloth together, as in U.S. Pat. No. 3,117,867. Yet, no attempt was made to provide a single pattern representative of the entire garment which could be customized to all of the individual dimensions of a woman. If separate patterns are needed to form individual sections of a garment so as to be customized to one dimension, then the entire utility of providing a universal pattern to custom fit all dimensions is defeated.

In order to overcome this deficiency in the prior art patterns for forming women's garments, various expensive and time consuming techniques have been developed to modify the basic garment formed from the standard size type pattern. As disclosed in U.S. Pat. No. 3,609,766, a trial garment, such as a dress, is made from a standard pattern. The trial dress is fitted on a particular figure and modified in accordance with the exact dimensions of that figure by the proper placement of seams, sizing of darts, etc. The modified dress elements are then separated from the trial dress and overlayed with clear flexible plastic material and the modified placement of the seams, darts, etc. drawn on the overlay and transferred to the standard pattern to customize the standard pattern to the particular individual. The customized pattern is then used to form a finished garment.

U.S. Pat. No. 3,883,955 goes one step further in attempting to adjust a standard size pattern to an individual figure. A plastic pattern form is provided with reference markings so the pattern form can be accurately placed on the person. Measurements of the hips, waist and bust are made and these measurements are transformed to two dimensional lines on the plastic pattern which is then used to alter the standard basic paper pattern to custom fit the garment to the individual measurements of the wearer.

Accordingly, the present invention provides an inexpensive solution to the custom-fitting of women's garments by furnishing a single, universal pattern for a complete women's garment which can be altered simply by taking the individual measurements of the woman in different key categories so the garment can be laid out and custom fitted prior to being sewn, without the aid of auxiliary overlays and the adjustments of standard size, single patterns.

SUMMARY OF THE INVENTION

In accordance with the invention, an empirical system has been developed for custom-fitting a particular style of different women's garments, such as slacks, bodices, skirts, dresses, coats and suits, as well as different components therefor, such as collars, necklines, sleeves, cuffs, waistbands and facings. A master basic pattern is provided forming an outline of the particular style garment, and by taking key individual size measurements of a woman, such as the waist, bust, hips, crotch, etc. a custom-fitted garment can be made by altering the master basic pattern by connecting various fixed, empirically deduced reference points on the pattern using a straight edge and a hip line curve drafting instrument and then cutting and sewing cloth corresponding to the pattern. The different components are coordinated by the same reference points with the different garments to which they can be added.

BRIEF DESCRIPTION OF THE DRAWINGS

Further objects and advantages of the invention will become apparent from the following description and claims and from the accompanying drawings, wherein:

FIG. 2 is a plan view of a number of charts used with the master pattern of FIG. 1 to customize the master pattern to the individual measurements of a woman;

FIG. 8 is a plan view of a chart used with the master pattern of FIG. 7 to customize the master pattern to the individual bust measurements of a woman;

FIGS. 11*a* to 11*g*, inclusive, are plan views illustrating the steps of forming darts in the bodice master pattern of FIG. 9;

DETAILED DESCRIPTION OF THE PREFERRED EMBODIMENTS

Figure 1:
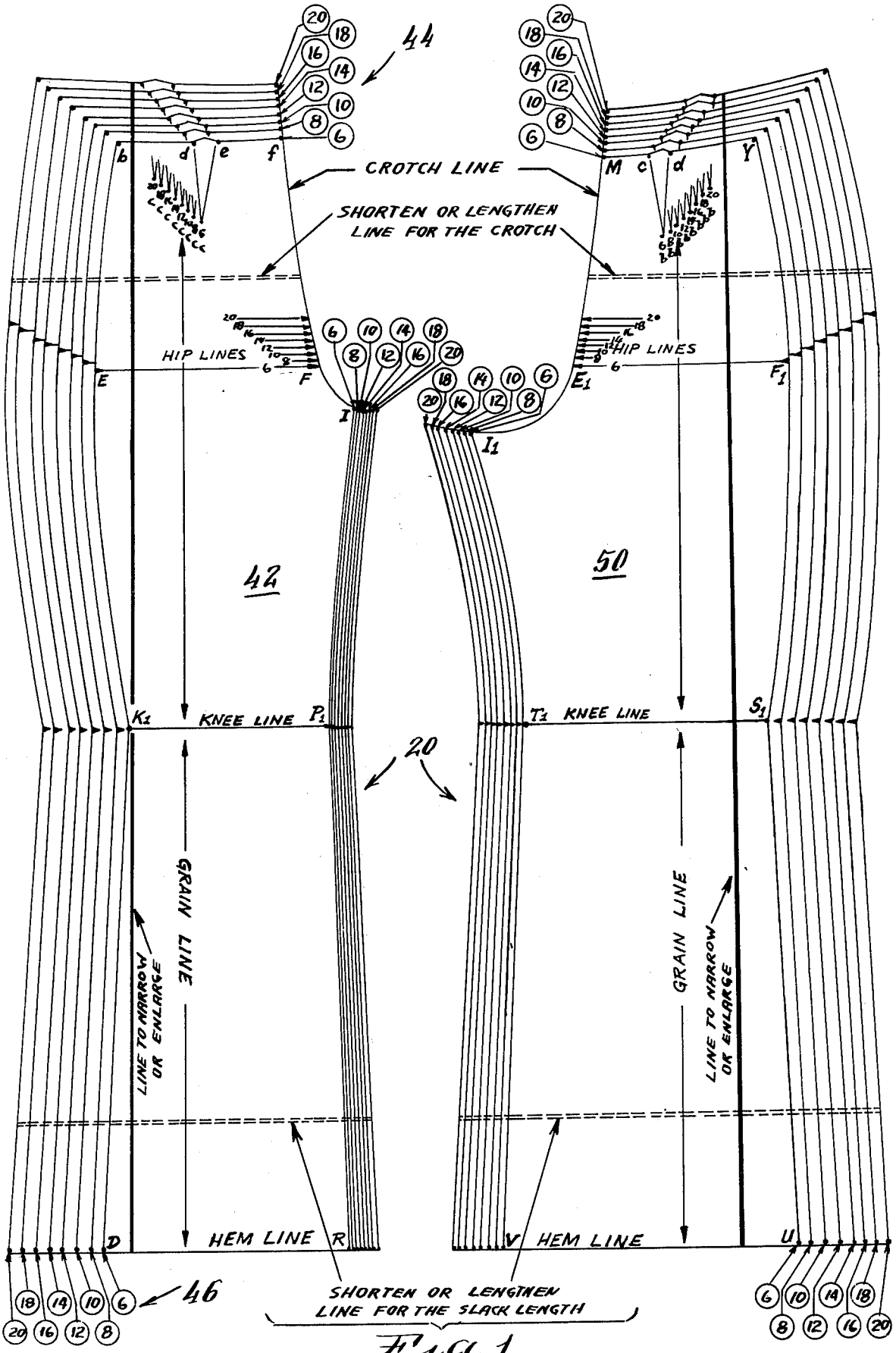
FIG. 1 is a plan view of one embodiment of a master pattern of the invention for forming the front and back of a custom-fitted pair of women's slacks.

Referring now to the drawings in detail, wherein like numerals indicate like elements throughout the several views, and particularly FIGS. 1 to 4, inclusive, a master pattern 20 is illustrated for forming a pair of custom-fitted women's slacks. Charts 22, 24, 26 and 28, along with a scale 30 having a front side 32 and a rear side 34 are also provided for use with pattern 20. The pattern, the charts, and the scale may be provided as parts of a kit for making the garment.

All important measurements and sizes for the many possible figure variations are empirically determined and pre-drawn on the master pattern 20 so all that the user has to do is mark her individual measurements on the charts 22, 24, 26 and 28, translate these measurements to reference points on the pattern, and join them up using scale 30. The pattern is then cut out which will be an accurate replica of her figure.

In using master pattern 20, the following measurements are made with a tape measure: (1) waist circumference; (2) hip circumference; (3) pants length from the front of the waistline down to the toes; and (4) crotch circumference taken between the legs from the front of the waistline to the rear of the waistline. When these measurements have been taken, the waist and hip measurements appearing in a column 36 are circled on each of the charts 22, 24, 26 and 28. The corresponding pattern size to be used for hip and waist lines is indicated in an adjacent column 38 on charts 22 and 24. Charts 26 and 28 also contain a column 36 relating to hip measurements, but the right-hand column 40 on each indicates an adjustment of the pattern that is to be made in inches for small or large figures, i.e., in the hips, as will be described hereinafter. If the hip measurement is under 34 inches, the pattern size "6" is used initially, and if the hip measurement is above 46 inches, the pattern size used initially is size "20".

The front portion 42 of master pattern 20 is then shaped by circling the point "b" corresponding to the waist measurement pattern size, ranging from "6" to "20" as marked on chart 24. The proper point is located by corresponding one of the points "b" with one of the reference circles 44 marked adjacent front pattern 42. The point "E" corresponding to the hip measurement pattern size, ranging from "6" to "20" as marked on chart 22 is also circled. This point is determined by aligning one of the points "E" with one of the reference circles 46 marked adjacent the bottom of front pattern 42. The lower curved edge of scale 30 is then used to join the circled points "b" and "E" by aligning the point "b" on front surface 32 with the circled point "b" on pattern 20 and pivoting scale 30 until the curved edge 48 is aligned with circled point "E". A curve is then drawn along edge 48 to join the points. One of the points "I" corresponding to the pattern size obtained from the hip measurement read from chart 22 is then circled at the bottom of the crotch line.

After the waist and hip line reference points have been located and connected and the point "I" has been circled at the bottom of the crotch line, the front pattern 42 is cut along the waist line corresponding to the waist pattern size determined by chart 24. The cut is continued along the hip curve drawn with scale 30 to point "E" and continued all of the way down to the hem line. After this is done, the pattern is cut from the beginning of the waist line along the crotch line, down to the hem line, following the hip size marked at point "I". The two points along the hem line are then cut to obtain the shaped pattern. The identical procedure is followed in shaping the back pattern 50. That is, point "Y" is circled corresponding to the pattern size on the waist line chart 24. Similarly, one of the points "$F_1$" is circled corresponding to the pattern size indicated by the hip measurement chart 22. These points are joined using the curved edge 48 of the scale 30 with the point "Y" on the surface 34 of scale 30 aligned with circled point "Y" on master pattern 50 and the line is drawn along curved edge 48 when the curved edge is aligned with the circled point "$F_1$". Finally, the point "$I_1$" along the crotch line on the back pattern 50 is also circled in accordance with the pattern size obtained from the hip measurement chart 22. As with the front pattern 42, the pattern 50 is cut in a similar manner. The front pattern 42 is then joined to the back pattern 50 with a small piece of tape along the points "I" and "$I_1$". The entire length of the curved crotch line is measured from the point "f" to the point "M" which is now fixed at the waist point cut. This measurement is compared to the crotch length measurement previously recorded by the person using the pattern. If the crotch length which had previously been measured is greater than the crotch line from points "f" to "M", the pattern crotch line needs to be lengthened. Conversely, if it is less, the crotch line needs to be shortened. Half of the difference is applied to shorten the length in the front pattern and the other half of the difference is applied to shorten or lengthen the back pattern 50. This is accomplished as follows:

Measure up from the "shortened or lengthened line for the crotch" on each pattern. A parallel line is drawn across the pattern at that point. The pattern is then folded up from the crotch line to the drawn line and fixed with a piece of tape. The same amount is shortened on both the front and back pattern. The crotch curve and the hip curve are redrawn where necessary and any excess paper of the pattern is trimmed away.

In order to lengthen the crotch, each of the front and back patterns 42 and 50 are slashed apart on the "shortened or lengthened line for the crotch". Additional pattern paper is placed under the two pieces of each slashed pattern. The pattern pieces are then spread to the exact amount needed to lengthen. The "grain line" on each pattern 42 and 50 is used as a guide line to keep the pattern straight. The spread pieces of each pattern are then taped together. The same amount is lengthened on both the front and back pattern. Crotch curve and hip curve are then redrawn where necessary and all excess paper is trimmed away.

To determine the proper length of the pants, the user records the distance between "f" at the waistline and either of the points "D" or "R". If the pattern pants length is longer than the user's pants length measurement, the pattern must be shortened by the amount of the difference. Conversely, if the pattern pants length is less than the user's own pants length measurement, the pattern must be lengthened by the requirement amount. This is accomplished as follows.

In order to shorten the pants to the proper size, the amount to be shortened is measured up from the "shorten or lengthen line" adjacent the bottom of each pattern. A parallel line to this line is drawn across the pattern. The pattern is folded up along the "shorten or lengthen line" to the drawn line and fixed with a piece of tape. The same amount is shortened on both the front and back pattern and any excess paper is trimmed away.

To lengthen the pants length, the pattern is slashed apart into two pieces along the "shorten or lengthen line". A piece of pattern paper is placed under the two slashed pieces on both the front and back patterns 42 and 50. The pattern pieces are spread the exact amount needed to lengthen it. The grain line indicated on the pattern is used as a guide line to keep the pattern straight. The two separate pieces of the pattern are then taped together. The same amount on both the front and back pattern is lengthened. The lines of the pattern are redrawn over the pattern paper placed beneath as necessary after shortening or lengthening.

Adjustments are then made to adjust the pattern for small or large figures, i.e., figures wherein the hip measurement is less than 34 inches or greater than 46 inches. In order to make this adjustment, the charts 26 and 28 are consulted.

In order to narrow the pattern for small hip measurements under 34 inches, the amount to be narrowed is indicated in column 40 adjacent to the actual hip measurement noted and circled in column 36. The amount indicated on the chart to narrow is measured from the "line to narrow or enlarge" on each pattern piece 42 and 50 toward the inside seam. This measurement is marked along the hem line, knee line, hip line and at the waist. These markings are then joined with a straight line which is supplied by the straight edge 52 of scale 30. The pattern is carefully folded along the "line to narrow or enlarge" up to the drawn line and fixed with tape. The same amount is narrowed to both the front and back patterns.

To enlarge the pants for large figures, the front and back patterns are slashed apart on the "line to narrow or enlarge". A piece of pattern paper is placed under the two separate pieces of each pattern. The pattern is spread apart the amount indicated on chart 28. The hip line and hem line are used as a guide to keep the pattern straight. Slashed pieces of pattern are then taped together. The same amount of enlargement is done for both the front and back patterns. Then an outline is drawn in at the waist and hem and any excess paper is trimmed away.

If the pattern calls for darts adjacent to the waistline, these can also be provided on both the front and back patterns 42 and 50. In order to mark the darts on the front pattern 42, it is only necessary to circle the point "c" corresponding to the pattern size of the waist indicated on chart 24. You also circle the waistline points "d" and "e" corresponding to the dart of the particular size called for and these circled points and then joined by straight lines to obtain the front dart. On the back pattern 50, the identical procedure if followed circling as reference points "b", "c" and "d". These circled points are joined by straight lines to obtain the back dart.

The customized pattern is then pinned to a fabric so that the fabric can be cut and seamed in a conventional manner. One point to be noted is that a seam allowance must be provided on the fabric. A $\frac{5}{8}$ of an inch seam allowance is provided around the pattern and a 3 inch hem allowance is provided at the hemline. In order to aid in drawing the seam allowance, scale 30 is provided with a vertical slot 54 which is $\frac{5}{8}$ of an inch from one of the vertical sides of scale 30. The slot can be placed over the edge of the pattern and the scale moved along the edge of the pattern which is viewed through slot 54 as marks are made along the vertical edge 58 on the fabric adjacent to the end of the pattern. These marks may be joined if desired, by connecting the marks with the edge 60 of slot 56 which is used as a straight edge to join the marks about the pattern.

Figures 3, 4, 5:
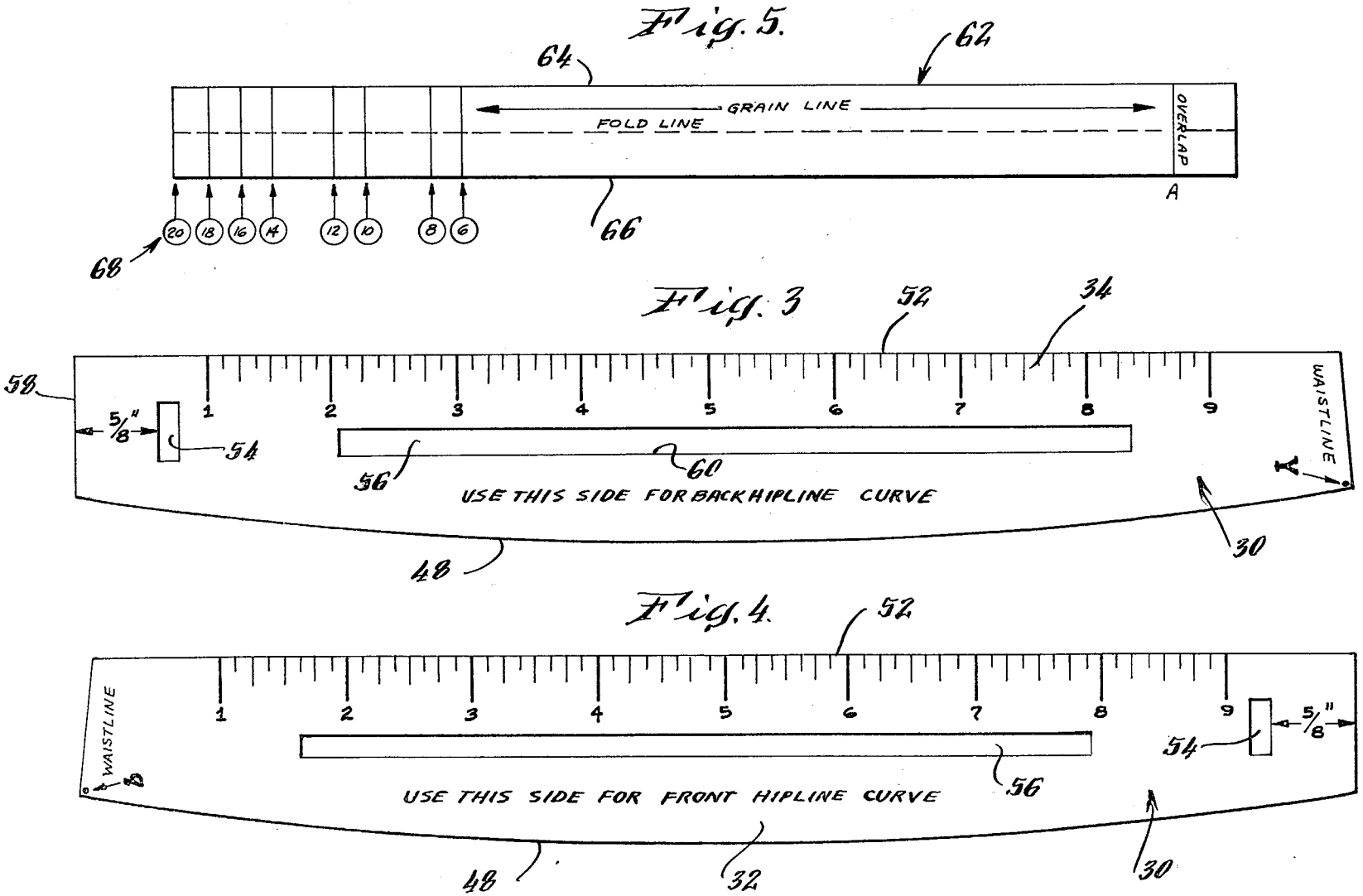
FIG. 3 is a plan view of the front of a scale used with the master pattern of FIG. 1.
FIG. 4 is a plan view of the rear of the scale of FIG. 3.
FIG. 5 is a plan view of a master pattern for forming a waist band.
Figure 6:
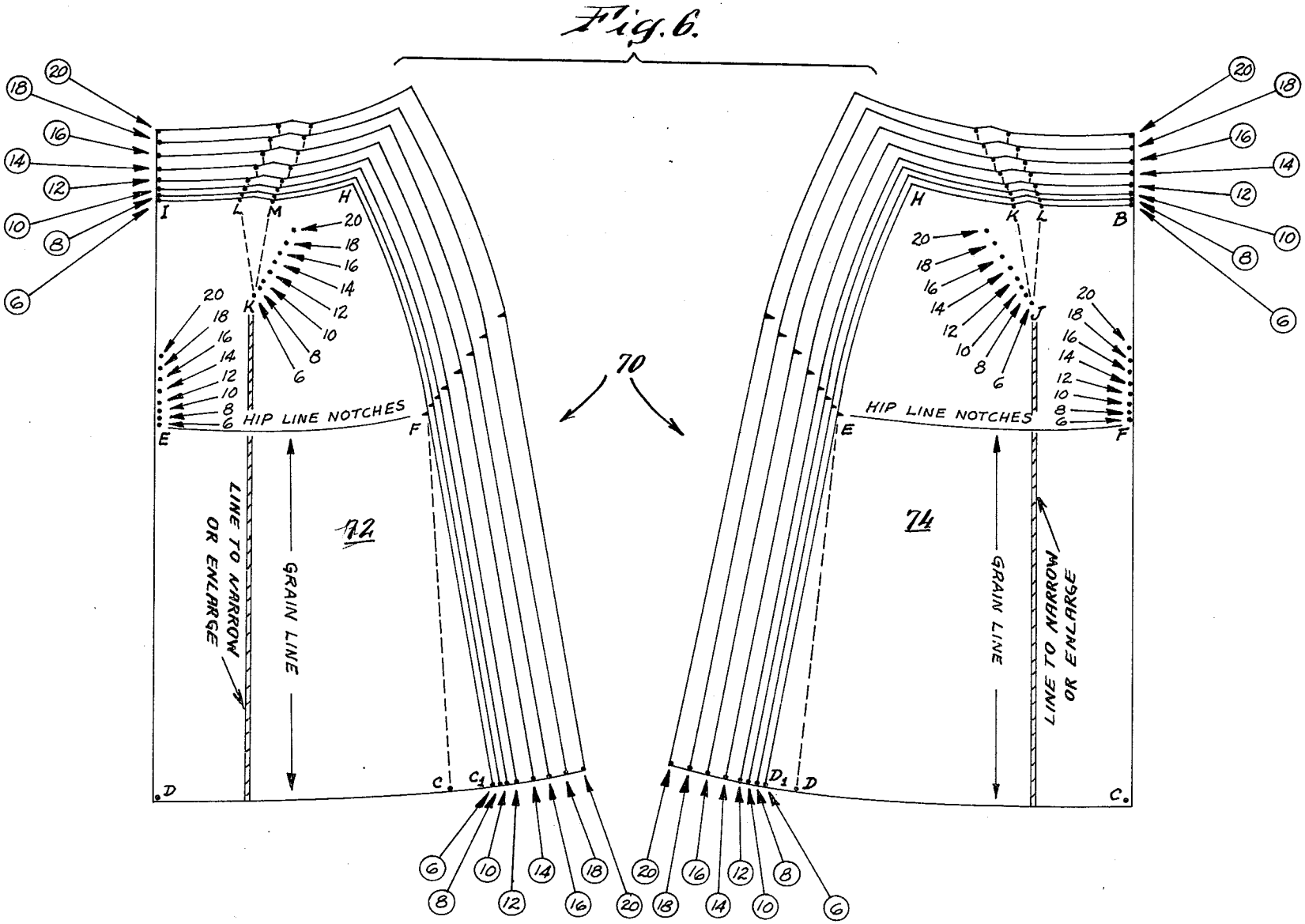
FIG. 6 is a plan view of still another embodiment of a master pattern of the invention for forming the front and back of a custom-fitted skirt.

FIG. 5 illustrates a waist band pattern 62 which can be used to form a waist band for the pants made by using the master pattern 20. This is accomplished by taking the exact waist circumference measurement from point "A" and placing a mark wherever the measurement ends. A perpendicular line is drawn through this mark perpendicular to the edges 64 and 66. The pattern sizes indicated by the circle 68 are of use as a guide. The pattern is then used to cut a waistband which is stitched in the conventional manner to the pants.

The concepts discussed above can be applied to other women's garments as well. For example, the same identical concepts can be applied to a pattern 70 for use in forming a woman's skirt. Master pattern 70 includes a back pattern 72 and a front pattern 74. The identical charts 22–28, inclusive, and scale 30 are used in identical manner to join various reference points along the waist and hip line to shape the garment. Points "M", "L" and "K" and similar points on the back pattern 74 are used to form darts. A line is also provided to narrow or enlarge the pattern for small or large figures.

With regard to master pattern 70, it will be readily apparent to those of ordinary skill in the art that once the pattern is shaped and customized, the line "B - C" on front pattern 74 and the line "I - D" on back pattern 72 are placed along the edge of a piece of folded fabric, marked on the fabric with an appropriate seam allowance, and cut to form the front and back of a skirt, leaving the folded fabric edge in tact so the front and back are duplicated in two joined pieces, one the mirror image of the other. Then, the complete back and front of the skirt are sewn together along the seams to provide a complete garment.

Figure 7:
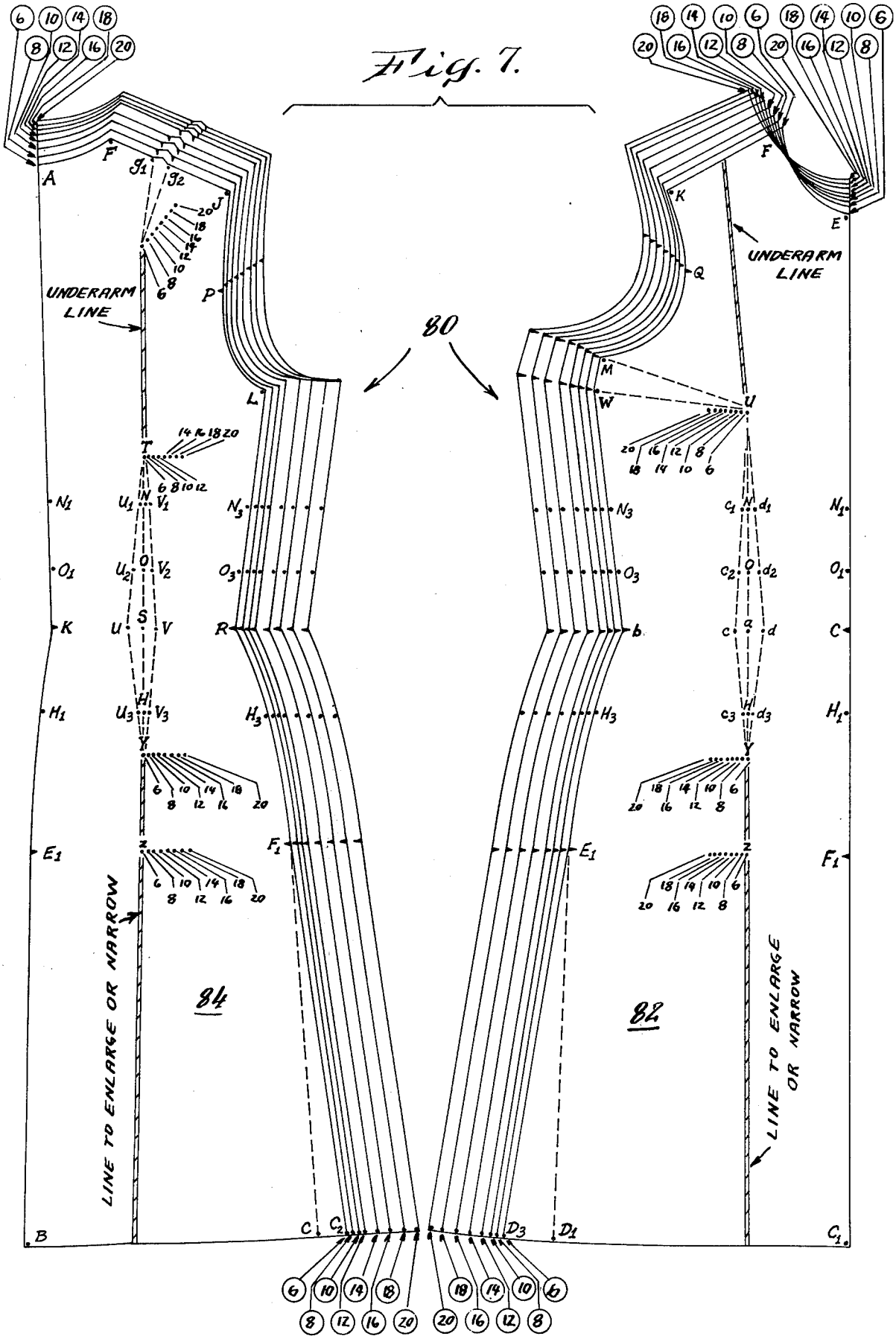
FIG. 7 is a plan view of yet another embodiment of a master pattern for forming a custom-fitted one piece dress.

FIG. 7 illustrates a master pattern 80 for forming a one-piece dress. The lower half of both the front pattern 82 and back pattern 84 taken about points "b", "C", "$C_1$" and "$D_3$", and "K", "R", "$C_2$" and "B", respectively, are substantially identical to skirt master pattern 72 and 74, respectively, and are shaped and used in the identical manner, except that the waist measurement chart 24 is not used to determine the points "b" and "C". These reference points along with "$E_1$" and "$D_3$" are determined from the hip measurement chart 22 in the manner previously described. This is true for both the front and back patterns 80 and 82. The style of the dress is such that the waistlines "b–C", and "K–R" are selected so that the hip measurement is the predominant feature, the waist being loose in the style of the one-piece dress pattern 80.

Figures 9, 12:
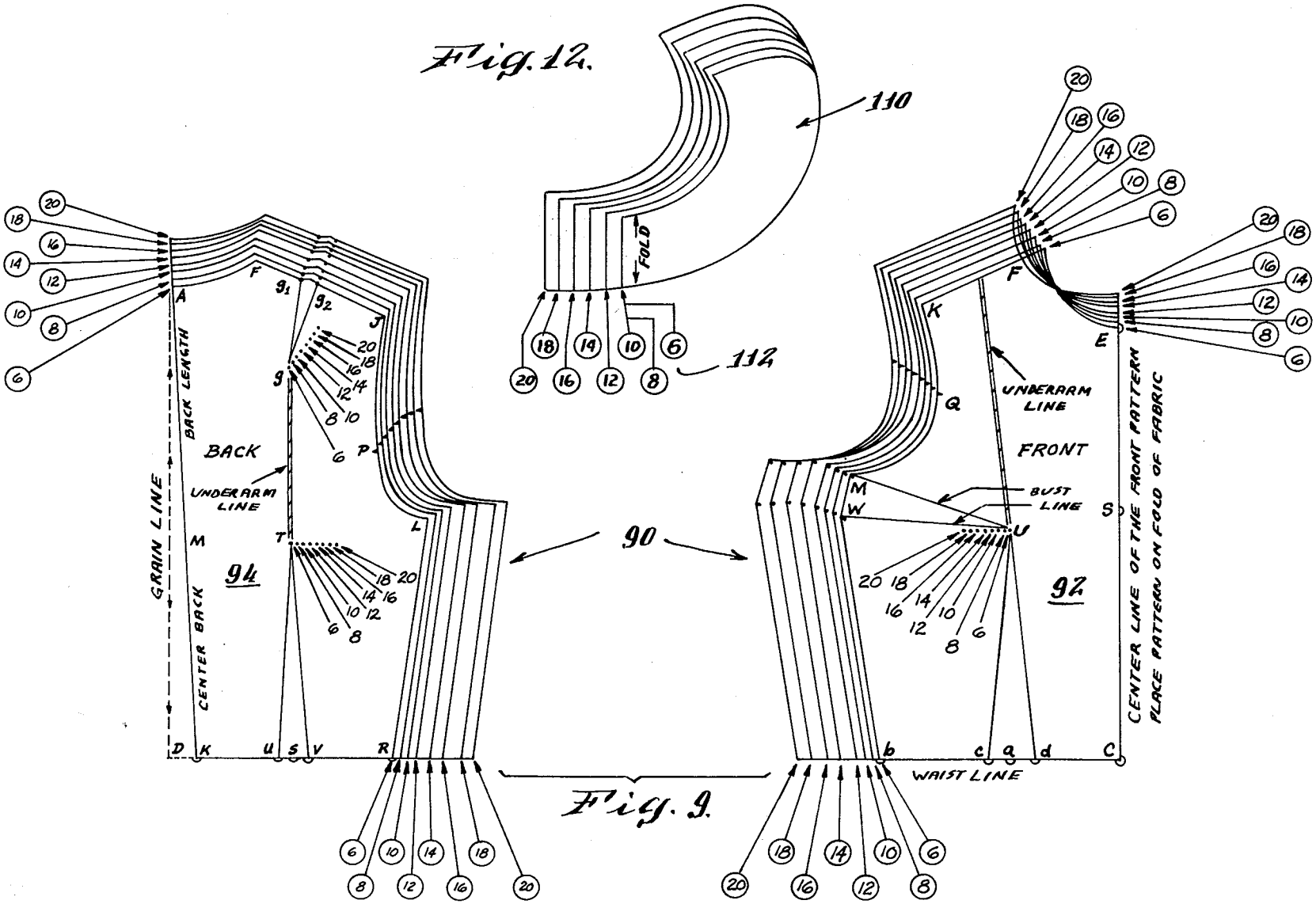
FIG. 9 is a plan view of still another master pattern of the invention for use in forming the front and back of a custom-fitted bodice.
FIG. 12 is a plan view of a master pattern for forming a collar for use with the dress pattern of FIG. 7 or bodice pattern of FIG. 9.

The upper portion of each of the front and back patterns 82 and 84 correspond identically to a bodice master pattern 90 comprising a front master pattern 92 and a back master pattern 94 illustrated in FIG. 9, except that the reference points "b" and "C" on front pattern 92 and the reference points "K" and "R" on back pattern 94 are determined from the waist measurement chart 24 in lieu of the hip measurement chart 22, as previously described. The use of the top portion of master patterns 82 and 84, as well as master patterns 92 and 94 are identical, however. The description of how to use the same should be understood to be applicable to each.

The top of the dress master patterns 82 and 84 and the front and back of the bodice patterns 92 and 94 are shaped by use of the hip measurement chart 22 and waist measurement chart 24, respectively, determine the reference points "$O_3$", "$N_3$", "W", "M", "Q", "K", "F", "E", and the corresponding points on the back master pattern. Points "F" and "E" and "A and F" determine the neck hole on the patterns which correspond to one of the hip or waist measurement sizes. Points "K" and "M" on the front patterns and "J" and "L" on the back patterns determine suitable sized sleeve or arm holes. As indicated above and described in detail hereinafter, the sleeves for the garments are coordinated with the various master patterns disclosed. The points "g", "$g_1$" and "$g_2$" on the back master patterns 84 and 94 are used to form darts in the identical manner disclosed with master pattern 20.

Since the upper portion of the front of dress pattern 82 and bodice pattern 92 are to constitute patterns for the upper portions of garments worn by a woman, suitable customizing of the pattern must be made for the various bust measurements of the woman. This is accomplished by use of the chart 100 illustrated in FIG. 8.

As illustrated in the left-hand column 102 on chart 100, the woman's bust measurement is indicated. A corresponding pattern size to the bust measurement is indicated in column 104 on the right-hand side of chart 100. This pattern size determines the location of reference point "U" on both master patterns 82 and 92. This reference point "U" is then joined by straight lines using the straight edge 52 of scale 30 to the points "M" and "W" previously determined from the hip or waist measurement chart 22 or 24. In addition to circling one of the points "U", a corresponding point "Y" is circled on the front master pattern 82 of the one-piece dress pattern 80. The lines "U" and "Y" are joined to move points "N", "O", "a", and "H" to the left corresponding to the bust pattern size. Lines parallel to the line running from "U" through "$c_1$", "$c_2$", "c" and "$c_3$" as well as the corresponding "d" points are also moved to the left a corresponding amount while drawing lines parallel thereto. Similar adjustments are made on the back pattern 84 of the one-piece dress pattern 80 between the reference points "T" and "Y", moving the lines "$U_1$" "$U_2$", "U" and "$U_3$", as well as the "B" reference points and the line "N", "O", "S" and "H" correspondingly to the right. In connection with the bodice master pattern 90, the point "U" is moved to the left on the front pattern 92 and corresponding parallel lines are drawn from the moved point "U" to points "c" and "d". Similarly, the point "T" is moved to the right on back pattern 94 as well as the corresponding "U" and "V", and new point "U" joined to reference points "M" and "W" by straight lines.

As previously discussed in connection with master pattterns 20 and 70, the patterns 82 and 84 are adjusted for abnormal hip measurements by using the charts 26 and 28 to locate the pattern size by moving the reference point "z" on patterns 82 and 84 to the left and right, respectively, and slashing or folding the pattern as previously described from the waist line "b–C" and "K–R" down. The patterns can also be cut along these lines when necessary before they are taped back together.

Once this has been accomplished, master pattern 80 is cut along its marked periphery. The same is done with master pattern 90.

The bust line darts are then formed in the patterns 80 and 90 to customize the pattern as substantially shown in FIGS. 11*a* to 11*g*, inclusive, depending upon the desired placement of the dart on the bodice and dress.

Figure 11A:
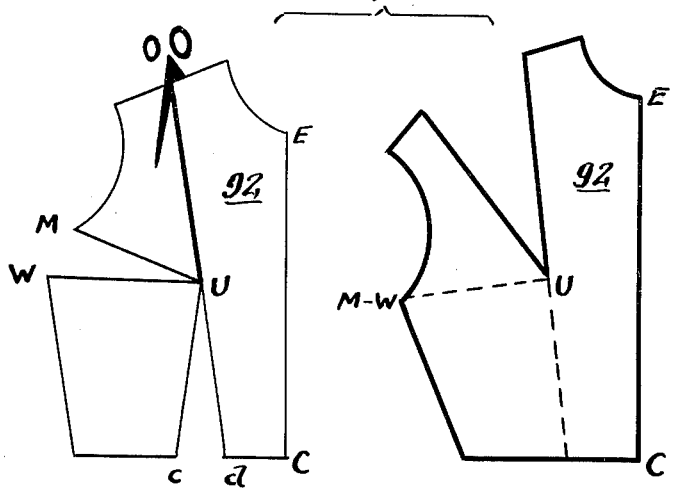

In FIG. 11*a*, the formation of a shoulder dart is illustrated on the bodice front master pattern 92. It should also be understood, however, that the formation of this dart is also applicable to the upper portion of the front master pattern 82 of the one-piece dress 80. After the periphery of the patterns have been cut in accordance with the waist measurement chart or hip measurement chart, as the case may be, the lines "M–U–W" and "c–U–d" are cut and the pattern material removed as illustrated in FIG. 11*a*. The patterns are then cut along the "underarm line" from the middle of the shoulder line "K–F" down to the reference point "U". After the "underarm line" has been cut, the darts "M–U–W" and "c–U–d" are closed as shown by the dotted lines in FIG. 11*a*. After this has been completed, it will be observed when the two darts are closed, a new dart is formed in place of the cut "underarm line".

The pattern is then traced with an appropriate seam allowance as described above in connection with the skirt master pattern 70 by placing the front of the patterns 80 and 90 along the fold line of the fabric to form a mirror image pattern of the front.

The back underline arm on master patterns 84 and 94 is left intact but the shoulder dart defined by lines "$G_1$", "G" and "$G_2$" are cut, as well as the dart indicated by line "T", "U" and "V". This pattern is then traced in the usual manner on the fabric with the fold line of the fabric along line "A–K" (in the case of the bodice back 94) and "A–B" (in the case of the one-piece dress back), with the usual seam allowance. When forming the garment, the darts on the fabric are of course seamed together.

Figure 11B:
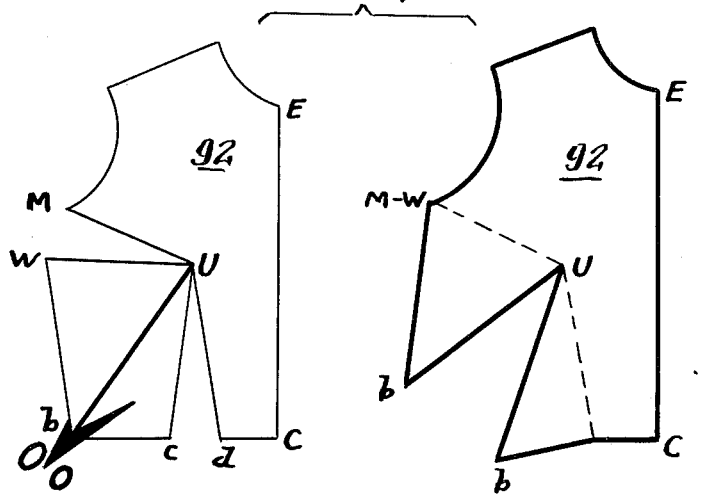
Figure 11C:
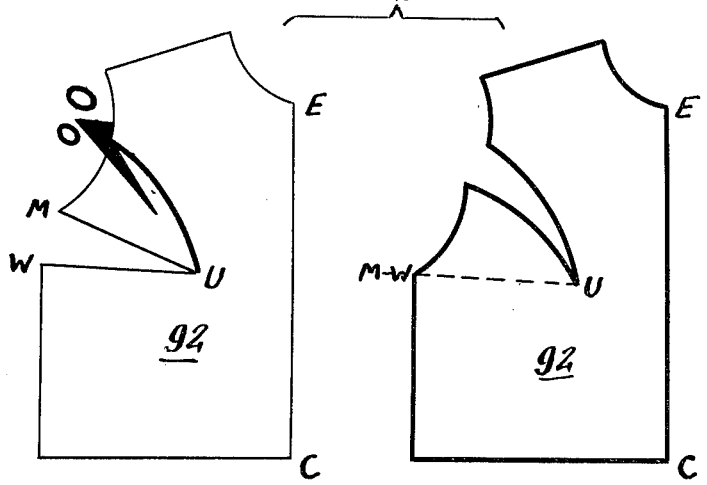

FIG. 11*b* illustrates the manner of forming a slanted side dart in the bodice front master pattern 92 (as well as one-piece dress master pattern 82). Once again, the front master pattern 92 is cut along the bust line "M–U–W" and the dart "c–U–d". The point "b" is joined with the point "U" by a straight line and the pattern cut through this line "b–U". After this has been completed, it will be observed that when the two darts are closed, a new dart is formed in the place of the cut line and the pattern is traced on the fabric as in conjunction with FIG. 11*a*. *FIG. 11c* illustrates the formation of a curved dart in the middle of the arm hole on master pattern 92 (once again, as well on master pattern 82). The line "M–U–W" is cut as before. The curved line is drawn from point "U" to the middle of the arm hole. The pattern is cut through this curve and the dart "M–U–W" whose close is indicated by the dotted line. It will be observed that when this dot is closed, a new dart is formed in place of the cut line.

Figure 11D:
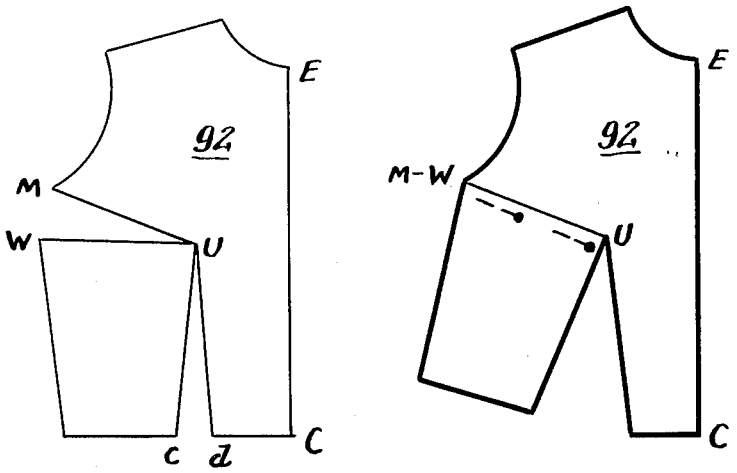

FIG. 11*d* illustrates the formation of a dart under the bust. Once again, the front master pattern 92 is cut along the darts "M-U-W" and "C-U-d". The dart "M--U-W" is closed. It will be observed that after this is accomplished, the dart "c-U-d" has acquired more fullness and the side line "E-C" and waist has taken a different inclination. By this procedure, using only one dart on the fabric, the same effect may be accomplished as with two darts, since the dart closed on the pattern is equivalent to a stitched dart on the material of the fabric. The darts marked on the fabric material can be used in various ways, as by sewing them either in darts, pleats, depending upon the style to be achieved.

Figure 11E:
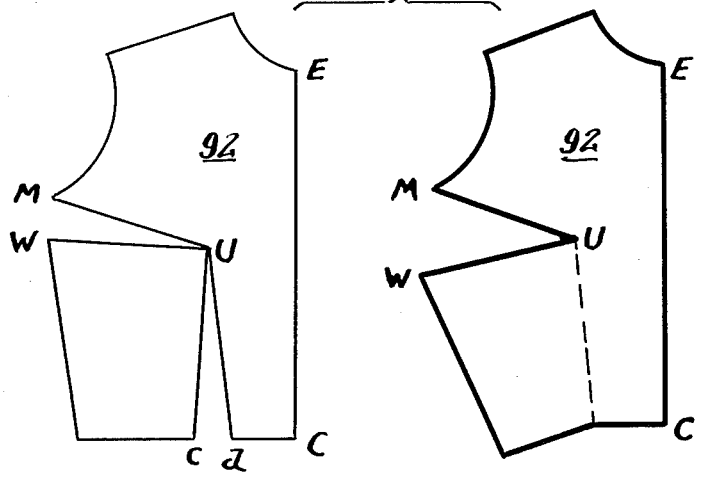

FIG. 11*e* illustrates the formation of a horizontal side dart by cutting the bust line dart "M-U-W" and the dart "c-U-d". To form this dart, dart "c-U-d" is closed to widen dart "M-U-W" which has taken on a further spreaded inclination. The pattern is then traced on the fabric and the dart closed in the usual manner after the fabric is cut.

Figure 11F:
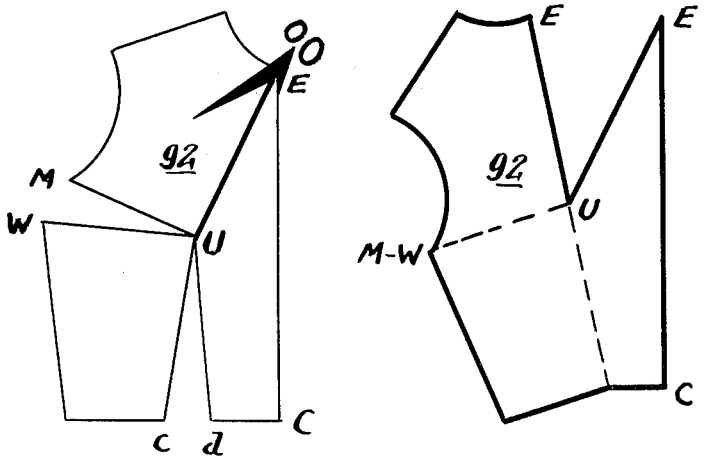

FIG. 11*f* illustrates the formation of a slanted dart to the neckline. Once again, the lines "M-U-W" and "c--U-d" are cut. A straight line is drawn from the point "U" to the point "E" on pattern 92. Line "E-U" is then cut and the points "M-W" and "c-d" joined as indicated in dotted lines. It will be observed when the two darts "M-U-W" and "c-U-d" are closed, a new dart is formed in the place of the cut line providing the slanted dart to the neckline on the fabric.

FIG. 11*g* illustrates the formation of a horizontal dart from the bust point to the center of the garment.

In the formation of this dart, the usual darts are cut along lines "M-U-W" and "c-U-d". A horizontal line is then drawn from the point "U" to the vertical line "E-C". The pattern is cut along this line to point "U". Once the darts "M-U-W" and "c-U-d" are closed it will be observed that a new dart is formed extending from point "U" to the line "E-C" which are now slanted in half. The pattern can then be cut in two ways as indicated by the two right-handed figures and orientations of FIG. 11*g* of master pattern 92.

It is also possible to form different neckline variations on both the front of the bodice master pattern 90 and the one-piece dress front master pattern 82.

Figure 10:
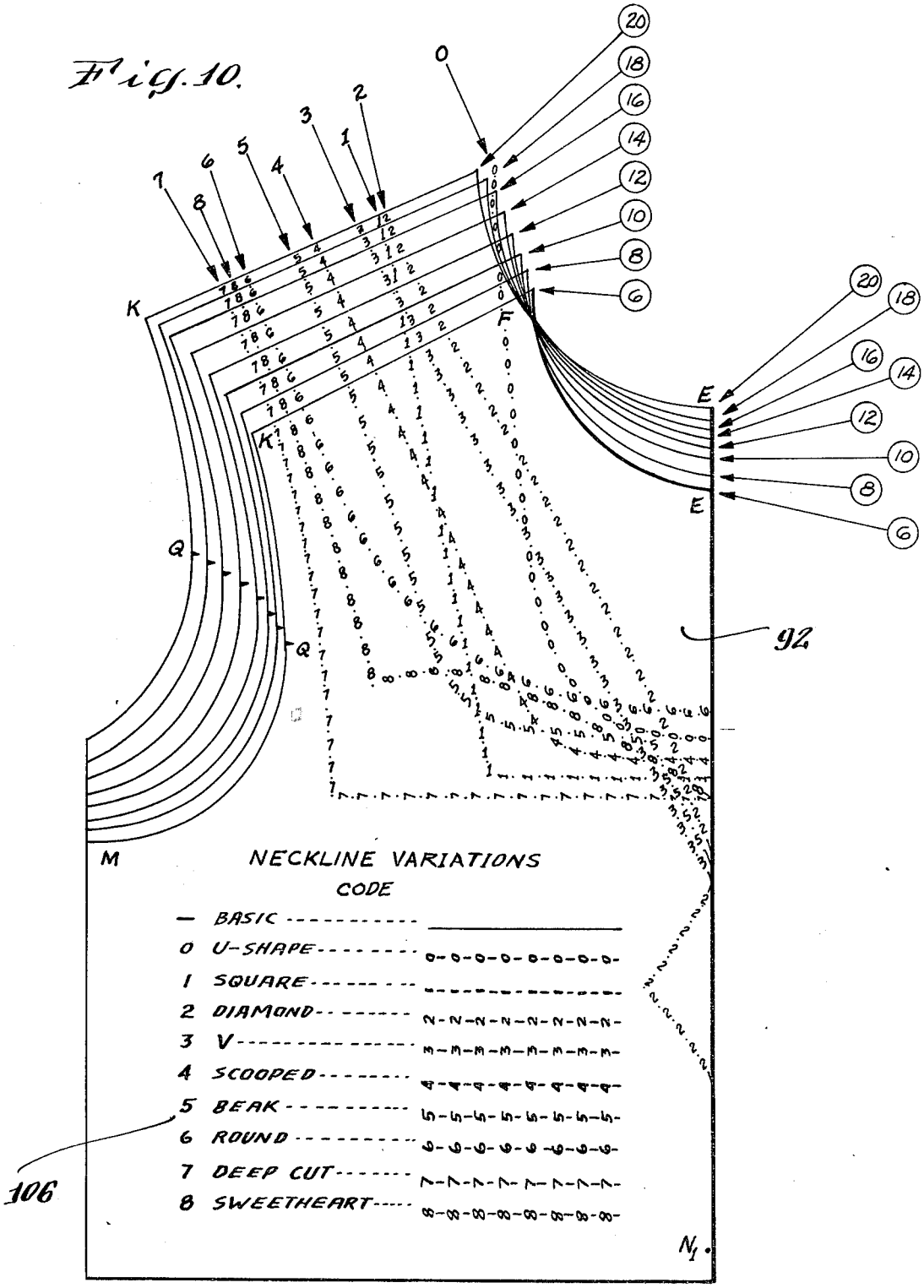
FIG. 10 is a plan view of the front master pattern of FIG. 9 indicating the manner of forming different neckline variations on the custom-fitted bodice.

The bodice master pattern 90 may have a front formed with a variety of different necklines. With specific reference to FIG. 10, the front master pattern 92 of the bodice pattern 90 is illustrated with nine different neckline variations which can be cut in the front master pattern 92. The front master pattern 92 can be provided with a series of chains of numbers ranging from "0" to "8" which define an outline of a different neckline configuration for the bodice or one-piece dress. The ninth neckline is indicated by the solid lines adjacent the neck opening. The various shapes are coded on the master pattern 92 as indicated in FIG. 10 so that the pattern may be cut along the chain of numbers to form the various neckline configurations running from "U-shaped" to "sweetheart" as indicated on the chart 106 in FIG. 10.

Figure 13:
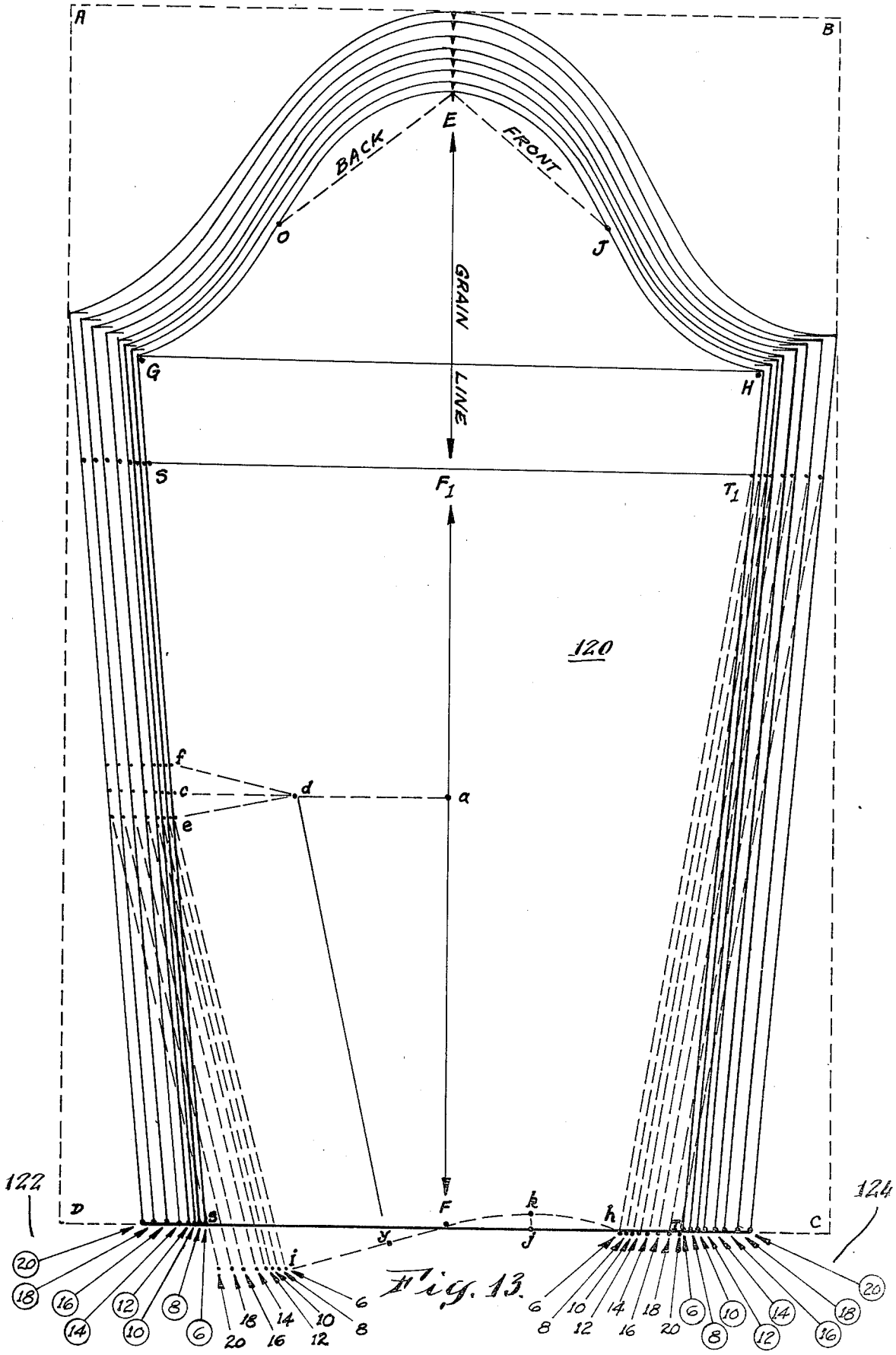
FIG. 13 is a plan view of a master pattern for forming a sleeve for the dress pattern of FIG. 7 or the bodice pattern of FIG. 9.

FIGS. 12 and 13 indicate that two accessories may be used with the bodice pattern 90 or the dress pattern 80. FIG. 12 illustrates a master pattern 110 for forming a flat-fitted collar for attachment to the one-piece dress or bodice. The pattern includes pattern size numbers 112 correlated to either the hip measurement chart in connection with the dress or the waist measurement chart in connection with the bodice along which the pattern can be cut so that it will exactly fit with either the patterns 92 or 82 at the neckline.

The sleeve master pattern 120 also includes lines about its periphery which are shaped in accordance with a hip measurement or waist measurement of the garment to which it is attached by using the pattern size numbers indicated at 122 and 124. Various different style sleeves may be produced for attachment to the dress or bodice by following the dotted lines rather than the full lines extending adjacent the peripheral edges of pattern 120. The pattern also includes a dart formed by lines d-e-f. It should also be noted that pattern 120 is a composite pattern including the front and back of the sleeve and when the fabric is cut, it is folded about the line "E-"F" and the appropriate seam made for the sleeves.

While a specific embodiment of universal custom fit garment patterns and method of using the same has been disclosed in the foregoing description, it will be understood that various modifications within the spirit of the invention may occur to those skilled in the art. Therefore, it is intended that no limitations be placed on the invention except as defined by the scope of the appended claims.

What is claimed as new is:

1. The method of customizing a universal garment pattern to exact figure measurements comprising the steps of:

providing a front and back master pattern which together form a complete pattern of a garment and include a series of graduated size lines about the periphery thereof and a series of reference points on the size lines of said master patterns, each series of size lines and reference points corresponding to a different figure measurement, determining each of said different figure measurements, marking said figure measurements on said front and back master patterns at predetermined points on said series of graduated size lines and on the interior of said master patterns corresponding to the different figure measurements to obtain a plurality of reference points, and shaping said patterns by drawing a line between the selected reference points whenever said reference points are on different size lines, and cutting said pattern along said shaped lines and graduated size lines corresponding to the different figure measurements.

2. The method of claim 1 including the further step of cutting said pattern along a second series of shaping lines provided between a plurality of secondary reference points, and closing the spaced portions provided by the cutting of one of said series of shaping lines.

3. The method of claim 2 including the further step of:

cutting a third line between a pair of reference points on said pattern, and closing the spaced portion provided by the cutting of said first and second series of shaping lines on said pattern.

* * * * *